US010036613B2

(12) United States Patent
Huff

(10) Patent No.: US 10,036,613 B2
(45) Date of Patent: Jul. 31, 2018

(54) SYSTEMS, DEVICES, AND/OR METHODS FOR MANAGING GUN SIGHTS

(71) Applicant: Stephen Huff, Hardy, VA (US)

(72) Inventor: Stephen Huff, Hardy, VA (US)

( * ) Notice: Subject to any disclaimer, the term of this patent is extended or adjusted under 35 U.S.C. 154(b) by 0 days.

(21) Appl. No.: 15/222,865

(22) Filed: Jul. 28, 2016

(65) Prior Publication Data

US 2017/0184375 A1 Jun. 29, 2017

Related U.S. Application Data

(60) Provisional application No. 62/216,296, filed on Sep. 9, 2015.

(51) Int. Cl.
*F41G 11/00* (2006.01)

(52) U.S. Cl.
CPC ..... *F41G 11/001* (2013.01); *F41G 11/003* (2013.01)

(58) Field of Classification Search
CPC .... F41G 11/001; F41G 11/003; F41G 11/002; F41G 11/005
USPC ..... 42/124, 132, 136, 127, 113
See application file for complete search history.

(56) References Cited

U.S. PATENT DOCUMENTS 4,200,989 A * 5/1980 Brouthers ..... F41G 1/26 42/137
4,628,611 A * 12/1986 Ruffino ..... F41G 1/16 42/137
5,388,335 A * 2/1995 Jung ..... F41G 1/26 42/115
5,467,552 A * 11/1995 Cupp ..... F41G 1/26 42/125
6,327,806 B1 * 12/2001 Paige ..... F41G 1/30 42/113
6,678,988 B1 * 1/2004 Poff, Jr. ..... F41G 11/002 42/124
6,722,074 B1 * 4/2004 Farrell ..... F41G 11/003 42/124
7,634,866 B2 * 12/2009 Javorsky ..... F41G 1/345 42/111
8,011,130 B2 * 9/2011 Chang ..... F41G 11/003 42/124
8,800,194 B2 * 8/2014 Teetzel ..... F41G 11/003 42/124
8,893,422 B2 * 11/2014 Wolf ..... F41A 3/12 42/111
9,068,801 B1 * 6/2015 Stecher, Jr. ..... F41G 11/00
9,453,706 B1 * 9/2016 Crispin ..... F41G 1/06
9,506,726 B2 * 11/2016 Wolf ..... F41G 1/26
2001/0022044 A1 * 9/2001 Spinner ..... F41G 11/001 42/124
2003/0056417 A1 * 3/2003 Horton ..... F41G 11/007 42/124
2006/0207157 A1 * 9/2006 Keng ..... F41G 1/32 42/132
2007/0006512 A1 * 1/2007 Williams ..... F41G 11/003 42/124

(Continued)

*Primary Examiner* — John Cooper
(74) *Attorney, Agent, or Firm* — Dale Jensen, PLC; Dale R. Jensen

(57) ABSTRACT

Certain exemplary embodiments can provide a system comprising a gun sight base. The gun sight base can define a plurality of apertures. The system can also comprise a cap that is couplable to the gun sight base. One of the base and the cap can define a recoil lug.

15 Claims, 18 Drawing Sheets

2000

(56) References Cited

U.S. PATENT DOCUMENTS

| | | | | |
|---|---|---|---|---|
| 2007/0234625 | A1* | 10/2007 | Kidd | F41G 1/02 42/111 |
| 2008/0216379 | A1* | 9/2008 | Javorsky | F41G 1/12 42/115 |
| 2008/0216380 | A1* | 9/2008 | Teetzel | F41G 11/003 42/127 |
| 2011/0314721 | A1* | 12/2011 | Lamb | F41G 1/10 42/145 |
| 2013/0061511 | A1* | 3/2013 | Strayer | F41G 1/10 42/136 |
| 2013/0219767 | A1* | 8/2013 | Peterson | F41G 11/003 42/113 |
| 2014/0053445 | A1* | 2/2014 | Wolf | F41A 3/12 42/14 |
| 2014/0230305 | A1* | 8/2014 | Zimmer | F41G 11/001 42/111 |
| 2014/0259855 | A1* | 9/2014 | Abo | F41G 1/345 42/132 |
| 2015/0241175 | A1* | 8/2015 | Wolf | F41G 11/005 42/124 |
| 2016/0091281 | A1* | 3/2016 | Gwillim, Jr. | F41G 1/345 42/111 |

* cited by examiner

10900

SYSTEMS, DEVICES, AND/OR METHODS FOR MANAGING GUN SIGHTS

CROSS-REFERENCES TO RELATED APPLICATIONS

This application claims priority to and incorporates by reference herein in its entirety, U.S. Provisional Patent Application Ser. No. 62/216,296, filed 9 Sep. 2015.

BRIEF DESCRIPTION OF THE DRAWINGS

A wide variety of potential practical and useful embodiments will be more readily understood through the following detailed description of certain exemplary embodiments, with reference to the accompanying exemplary drawings in which.

DETAILED DESCRIPTION

Certain exemplary embodiments can provide a system comprising a gun sight base. The gun sight base can define a plurality of apertures. The system can also comprise a cap that is couplable to the gun sight base. One of the base and the cap can define a recoil lug.

Figure 1:
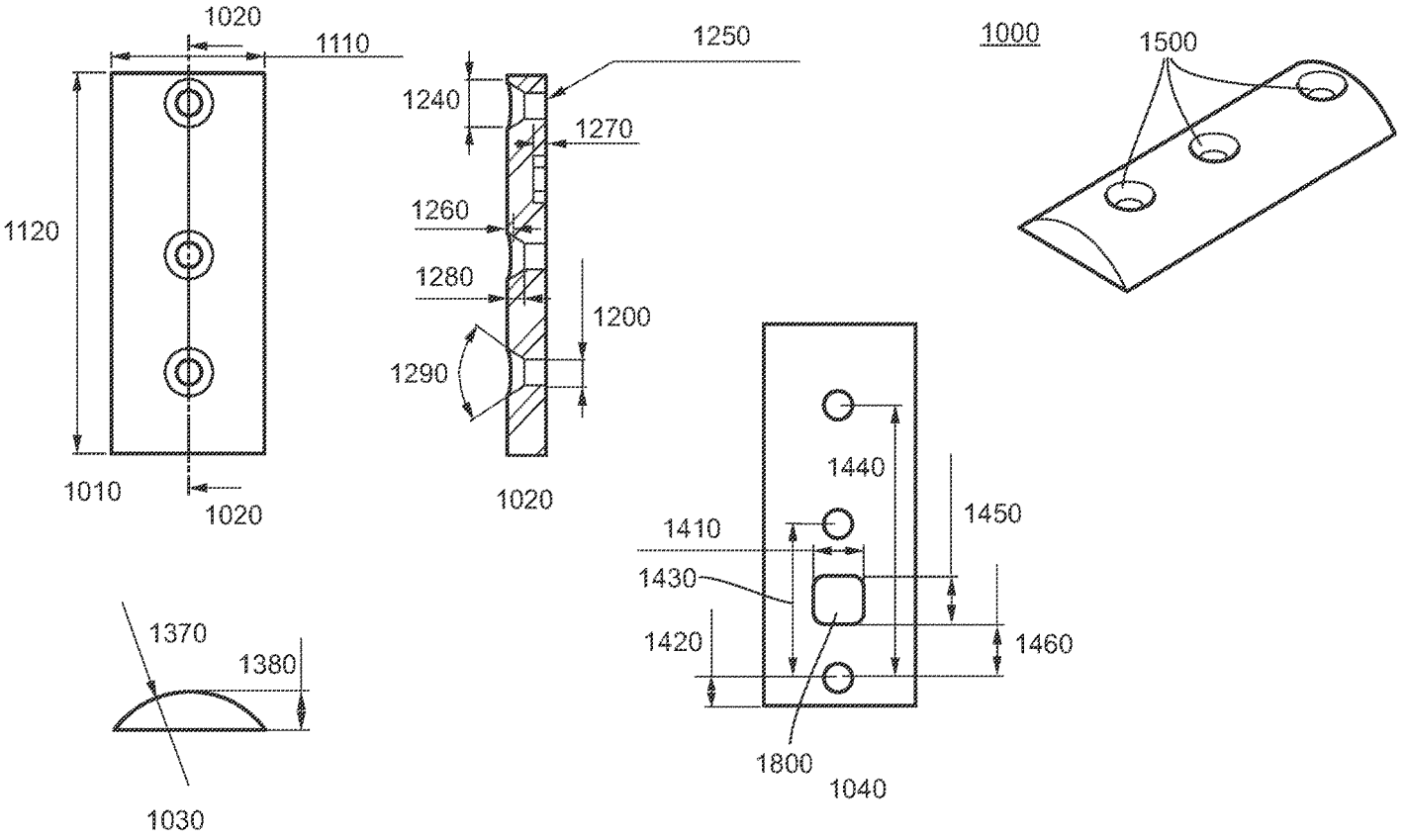
FIG. 1 is a detailed drawing showing five views of an exemplary embodiment of a cap 1000.

FIG. 1 is a detailed drawing showing five views of an exemplary embodiment of a cap 1000, which can be constructed to be coupled to a sight for a firearm. The sight can be a Patridge sight (i.e., an open sight comprising a substantially rectangular rear sight with a notch in the middle), a fixed sight, an adjustable sight, a night sight, a fiber optic sight, or a scope, etc. The illustrated embodiment defines a plurality of bore holes 1500 constructed to receive fasteners and, thereby, to be releasably coupled to a first corresponding plurality of apertures defined by a body of a firearm and a second corresponding plurality of apertures defined by a sight mounting adapter. Certain exemplary embodiments of cap 1000 can define two bore holes 1500. Cap 1000 can also comprise a recoil lug 1800 and/or define a cavity constructed to engage a recoil lug, which is constructed to restrain motion of cap 1000 in at least two directions relative to the body of the firearm. In the illustrated embodiment, recoil lug 1800 is substantially square shaped with rounded corners. Recoil lug 1800 can either protrude or be recessed to compatibly engage with a corresponding lug of the firearm or a second component of a system coupleable to the firearm. As illustrated, cap 1000 comprises a substantially planar base, with the exception of recoil lug 1800, and a rounded convex apex surface with the exception of bore holes 1500.

Detailed dimensions and fabrication instructions can be selected to comport to dimensions of any firearm. Plan view 1010 of cap 1000 can define a cross-section 1020. A typical length 1120 of cap 1000 can be approximately 2.000 inches with a tolerance of approximately −0.002 inches (i.e., up to 0.002 inches less than 2.000 inches). A typical width 1110 of cap 1000 can be approximately 0.800 inches with a tolerance of approximately +/−0.005 inches (i.e., up to 0.005 inches above or below 0.800 inches).

Cross-section 1020 can define other typical dimensions and/or fabrication instructions. Dimensions of cross-section 1020 can be as follows for an exemplary embodiment:

- aperture diameter 1240 can be approximately 0.25 inches for each of the three illustrated bore holes 1500;
- aperture countersink depth 1260 can be approximately 0.02 inches for each of the three illustrated bore holes 1500;
- recoil lug depth 1270 can be approximately 0.08 inches;
- aperture head depth 1280 can be approximately 0.09 inches for each of the three illustrated bore holes 1500; and/or
- aperture foot diameter 1200 can be approximately 0.14 inches for each of the three illustrated bore holes 1500.

Cross-section 1020 can comprise the following instructions:

- instruction 1250 can be to chamfer each of illustrated bore holes 1500 to approximately 0.10 inches; and/or
- instruction 1290 can be to cut fastener head countersink angles at approximately 82 degrees.

Section 1030 can specify an overall depth of cap 1000 at approximately 0.200 inches. Section 1030 can specify a radius of curvature of approximately 0.500 inches for cap 1000.

Bottom view 1040 of cap 1000 defines the following typical dimensions:

- width 1410 of recoil lug 1800 can be approximately 0.250 inches with a tolerance of approximately +0.002 inches;
- centerline offset 1420 can be approximately 0.155 inches;
- aperture offset 1430 can be approximately 0.800 inches;
- aperture centerline offset 1440 can be approximately 1.420 inches;
- length 1450 of recoil lug 1800 can be approximately 0.250 inches with a tolerance of approximately +0.002 inches; and/or
- recoil lug offset 1460 can be approximately 0.275 inches.

Figure 1A:
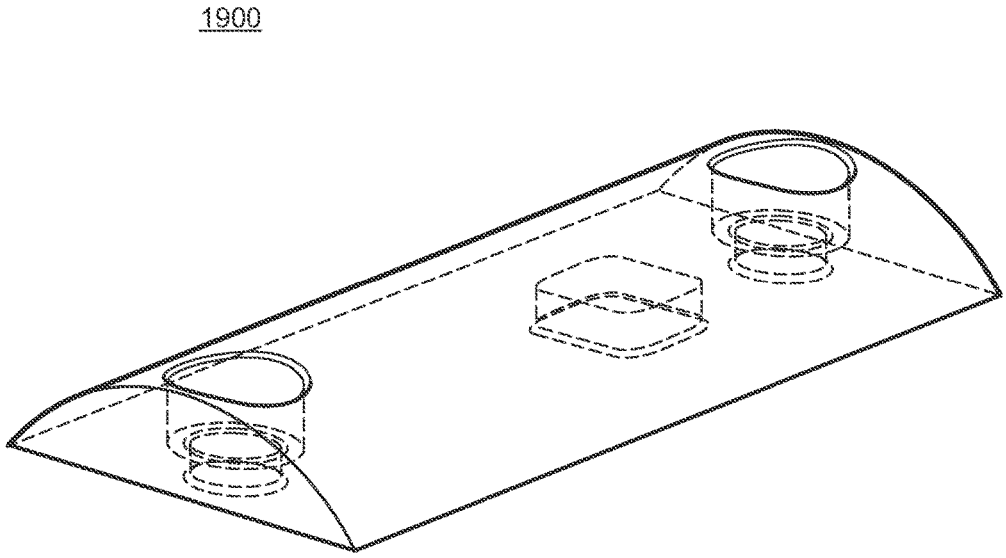
FIG. 1A is a perspective view of an exemplary embodiment of a cap 1900.

FIG. 1A is a perspective view of an exemplary embodiment of a cap 1900, which illustrates the apertures and the recoil lug with internal portions shown by dashed lines.

Figure 2:
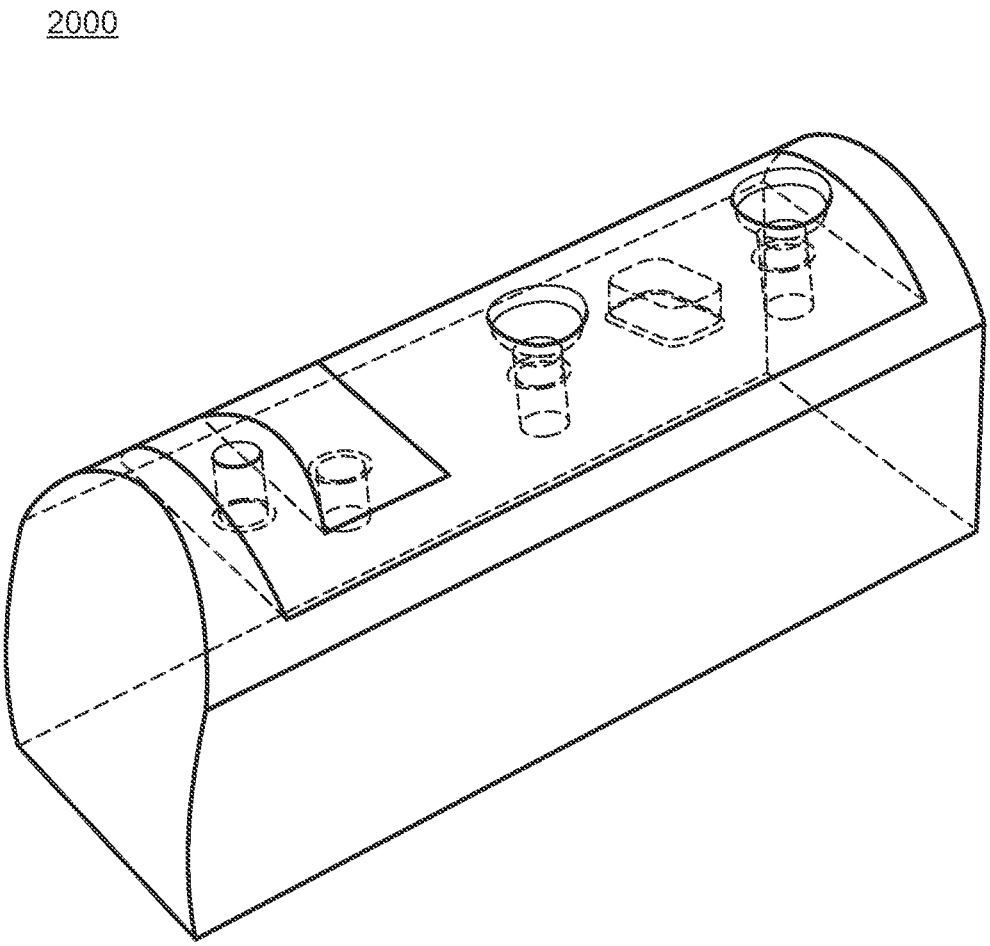
FIG. 2 is a perspective view of an exemplary embodiment of a system 2000.

FIG. 2 is a perspective view of an exemplary embodiment of a system 2000, which can be constructed to accept a sight for a firearm. System 2000 defines a plurality of bore holes constructed to receive fasteners and, thereby, couple a cap of system 2000 to a base of system 2000. The illustrated embodiment defines a recoil lug.

Figure 3:
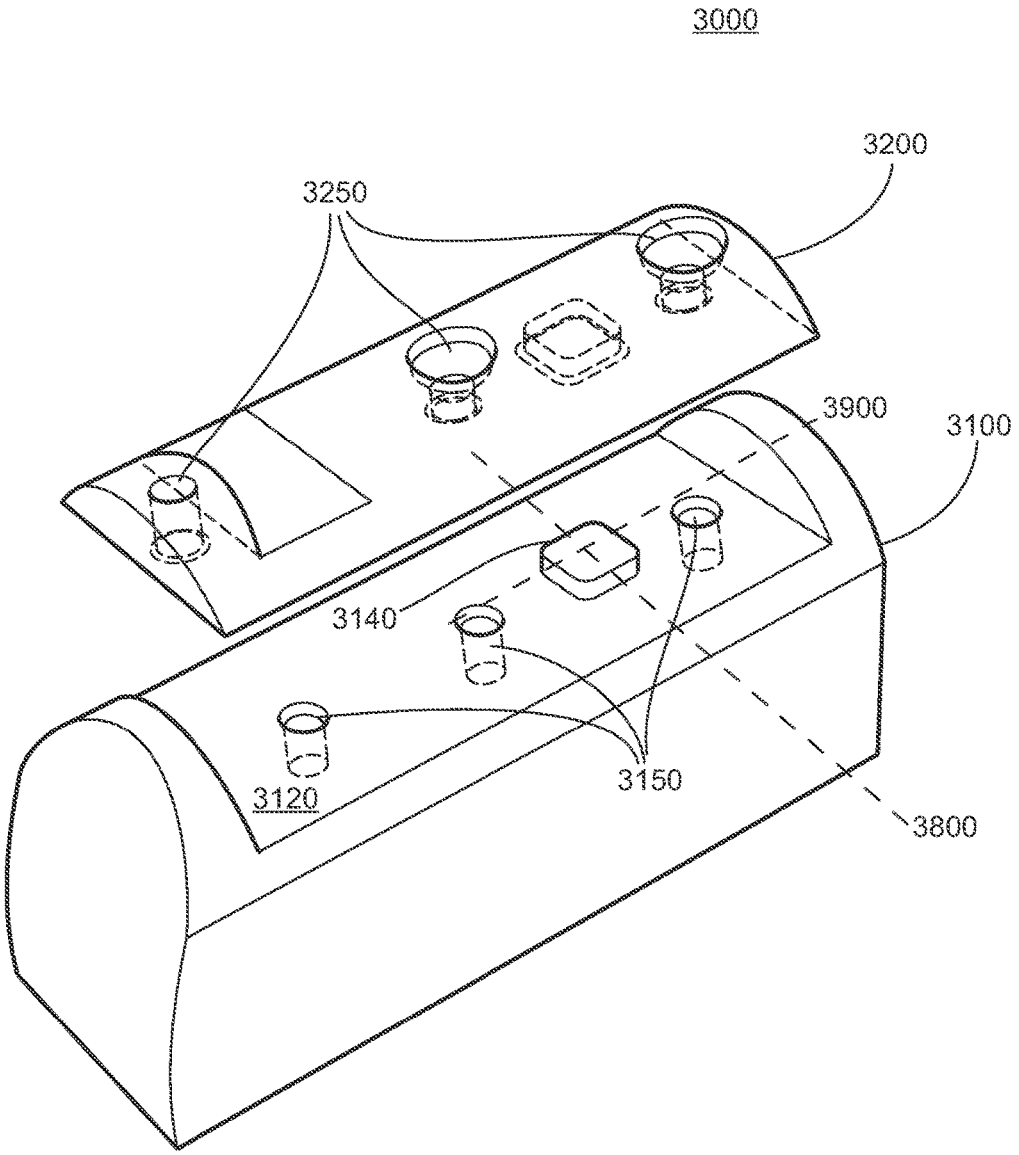
FIG. 3 is a perspective view of an exemplary embodiment of a system 3000.

FIG. 3 is a perspective view of an exemplary embodiment of a system 3000, which comprises a base 3100 and a cap 3200. System 3000 is constructed to releasably couple a firearm to a sight. Base 3100 comprises a recessed portion 3120, which defines a plurality of bore holes 3150 and comprises a recoil lug 3140, which protrudes. Base 3100 can be machined into a surface of a firearm (e.g., a surface of a firearm slide). Cap 3200 defines a plurality of cap bore holes 3250 and a recessed recoil lug portion (hidden in the view shown in FIG. 3). The recessed recoil lug portion is constructed to tightly engage with recoil lug 3140 such that motion of base 3100 is restrained in all three directions when cap 3200 is coupled to base 3100 via fasteners.

Base 3100 can be called a gun sight base, defines plurality of bore holes 3150. Cap 3200 is coupleable to base 3100. Recoil lug 3140, which defined in the illustrated embodiment by base 3100, is constructed to engage with a corresponding cavity defined by whichever of the gun sight base and the cap does not define the recoil lug (in the illustrated embodiment, the corresponding cavity is defined by cap 3200—see, e.g., ghost lines showing the corresponding cavity in FIG. 1A). When base 3100 and cap 3200 are coupled, recoil lug 3140 restrains motion of cap 3200 in at least two substantially perpendicular directions 3800 and 3900 relative to a body of the firearm defining base 3100. Recoil lug 3140 also serves as an "indexing lug" that provides a means of assuring that cap 3200 is exactly positioned on base 3100 each time cap 3200 is coupled to base 3100. This maintains a point of impact of the sighting system coupled to the cap, or what is referred to as the "zero" in firearms terminology. Certain exemplary systems can comprise a plurality of recoil lugs. In certain exemplary embodiments, system 3000 can comprise and/or have characteristics of:

- the firearm;
- a scope coupled to cap 3200;
- recoil lug 3140 is substantially square with rounded corners;
- base 3100 defines recoil lug 3140;
- cap 3200 defines recoil lug 3140 (inverted from the embodiment illustrated in FIG. 3;
- cap 3200 is coupled to a fixed sight;
- cap 3200 is coupled to an adjustable sight;
- cap 3200 is coupled to a night sight;
- cap 3200 defines a Picattiny rail;
- cap 3200 is coupled to a fiber optic sight; and/or
- cap 3200 defines an open sight.

Figure 4:
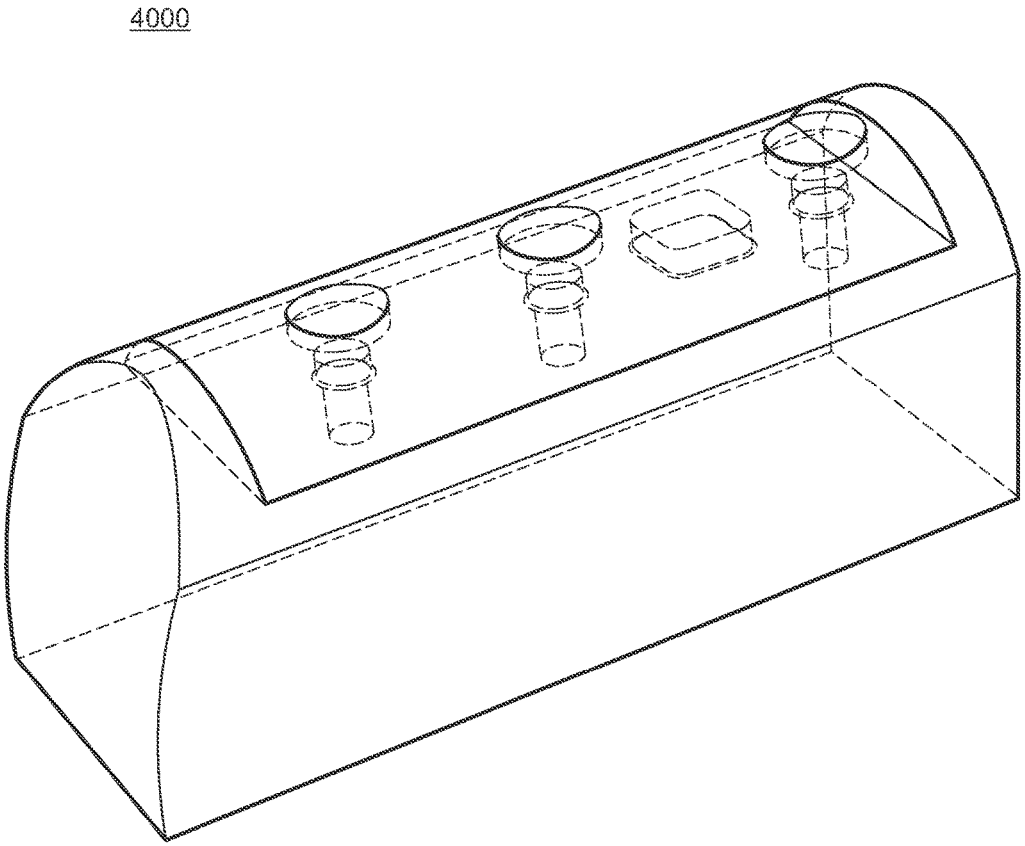
FIG. 4 is a perspective view of an exemplary embodiment of a system 4000.

FIG. 4 is a perspective view of an exemplary embodiment of a system 4000, which can be constructed to accept a sight for a firearm. System 4000 defines a plurality of bore holes constructed to receive fasteners and, thereby, to releasably couple a cap of system 4000 to a base of system 4000.

Figure 5:
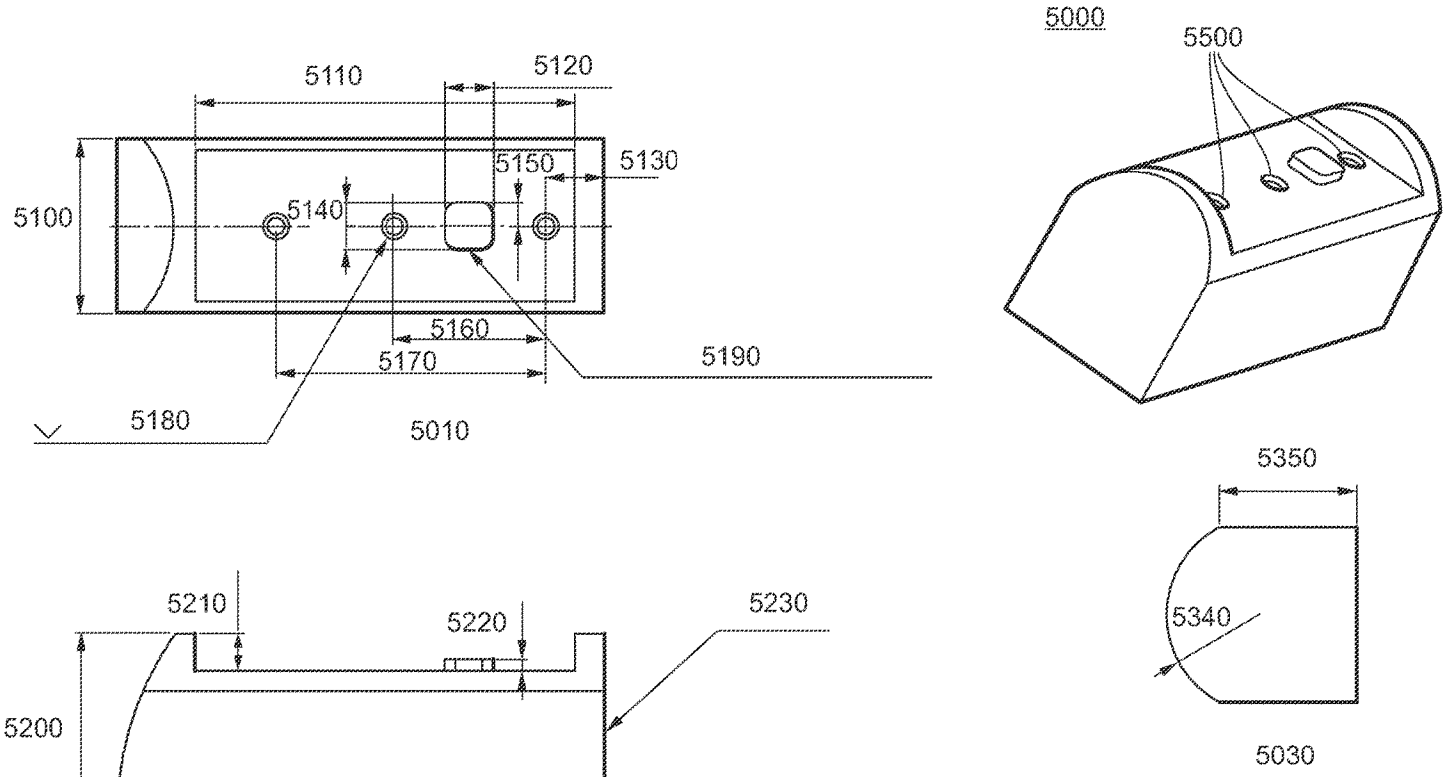
FIG. 5 is a detailed drawing showing four views of an exemplary embodiment of a base 5000.

FIG. 5 is a detailed drawing showing four views of an exemplary embodiment of a base 5000. Base 5000 is constructed for use in releasably coupling a firearm to a sight. Base 5000 comprises a recessed portion, which defines a plurality of bore holes and comprises a protruding recoil lug. Base 5000 can be machined into a surface of a firearm (e.g., a surface of a firearm slide). Base 5000 is constructed to be releasably coupled to a cap (e.g., the cap of cap 1000). The recessed recoil lug portion of the cap is constructed to tightly engage with the protruding recoil lug portion of base 5000 such that motion of the cap and the sight coupled thereto is restrained in all three directions when base 5000 is coupled to the cap via fasteners.

Detailed dimensions and fabrication instructions can be selected to comport to dimensions of any firearm. Plan view 5010 of base 5000 can be used to specify dimensions and/or fabrication instructions, which comprise:

- a typical width 5100 of cap 1000 can be approximately 0.920 inches;
- a length 5110 of a recessed portion of base 5000 can be approximately 2.000 inches with a tolerance of approximately +0.002 inches (i.e., up to 0.002 inches greater than 2.000 inches);
- recoil lug length 5120 can be approximately 0.250 inches with a tolerance of approximately −0.001 inches (i.e., up to 0.001 inches less than 0.250 inches);
- centerline offset 5130 can be approximately 0.302 inches;
- recoil lug width 5140 can be approximately 0.250 inches with a tolerance of approximately −0.001 inches (i.e., up to 0.001 inches less than 0.250 inches);
- recoil lug half-width 5150 can be approximately 0.125 inch;
- aperture spacing 5160 can be approximately 0.80 inch;
- aperture spacing 5170 can be approximately 1.42 inch;
- instruction 5180 provides for three apertures of approximately 0.102 inches drilled to a depth of approximately 0.18 inches and threaded (e.g., with 6-32 UNC threads tapped to a depth of approximately 0.15 inches) and a near side countersink depth of approximately 0.14 inches and an angle of intersection of the different diameter apertures of approximately 90 degrees; and/or
- instruction 5190 provides for a chamfer around the top of the boss of approximately 0.10 inches.

Side view 5020 can define other typical dimensions and/or fabrication instructions. Dimensions of side view 5020 can be as follows for an exemplary embodiment:

- base height 5200 can be approximately 1.014 inches;
- a recess depth 5210 can be approximately 0.200 inches;
- recoil lug height 5220 can be approximately 0.063 inches; and/or
- a breach face 5230 can be substantially vertical relative to a substantially planar floor 5240 of base 5000.

End view 5030 can comprise the following specifications:

- Partial base height 5350 can be approximately 0.710 inches; and/or
- Radius of curvature 5340 can be approximately 0.500 inches.

Figure 6:
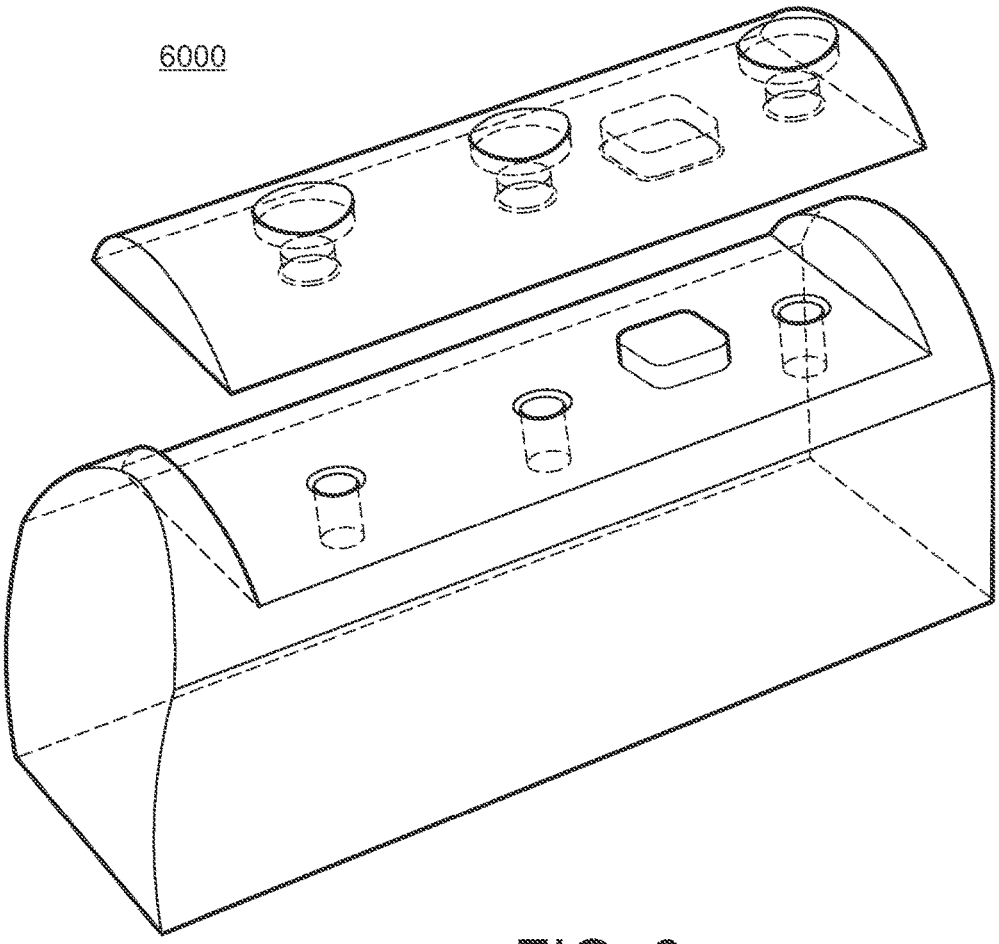
FIG. 6 is a perspective view of an exemplary embodiment of a system 6000.

FIG. 6 is a perspective view of an exemplary embodiment of a system 6000. System 6000 comprises a recessed portion, which defines a plurality bore holes and comprises a protruding recoil lug. The recessed recoil lug portion is constructed to tightly engage with the protruding recoil lug portion such that is restrained in all three directions when a cap of system 6000 is coupled to a base of system 6000 via fasteners.

Figure 6A:
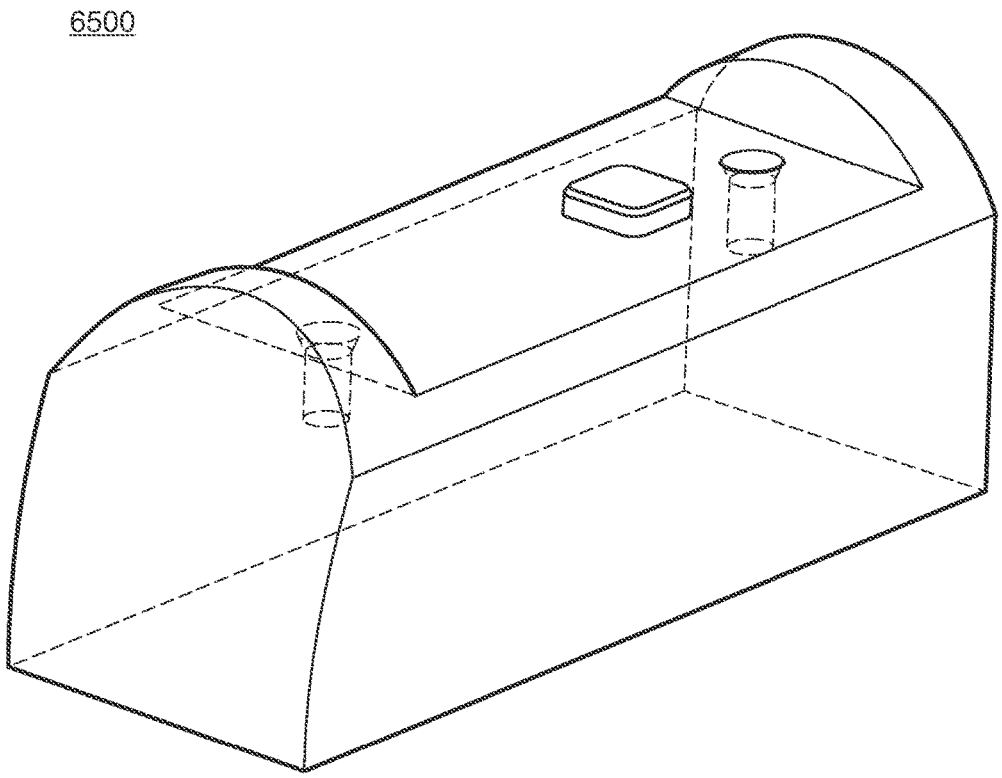
FIG. 6A is a perspective view of an exemplary embodiment of a base 6500.

FIG. 6A is a perspective view of an exemplary embodiment of a base 6500, which illustrates additional recoil lug detail and the apertures with internal portions shown by dashed lines.

Figure 7:
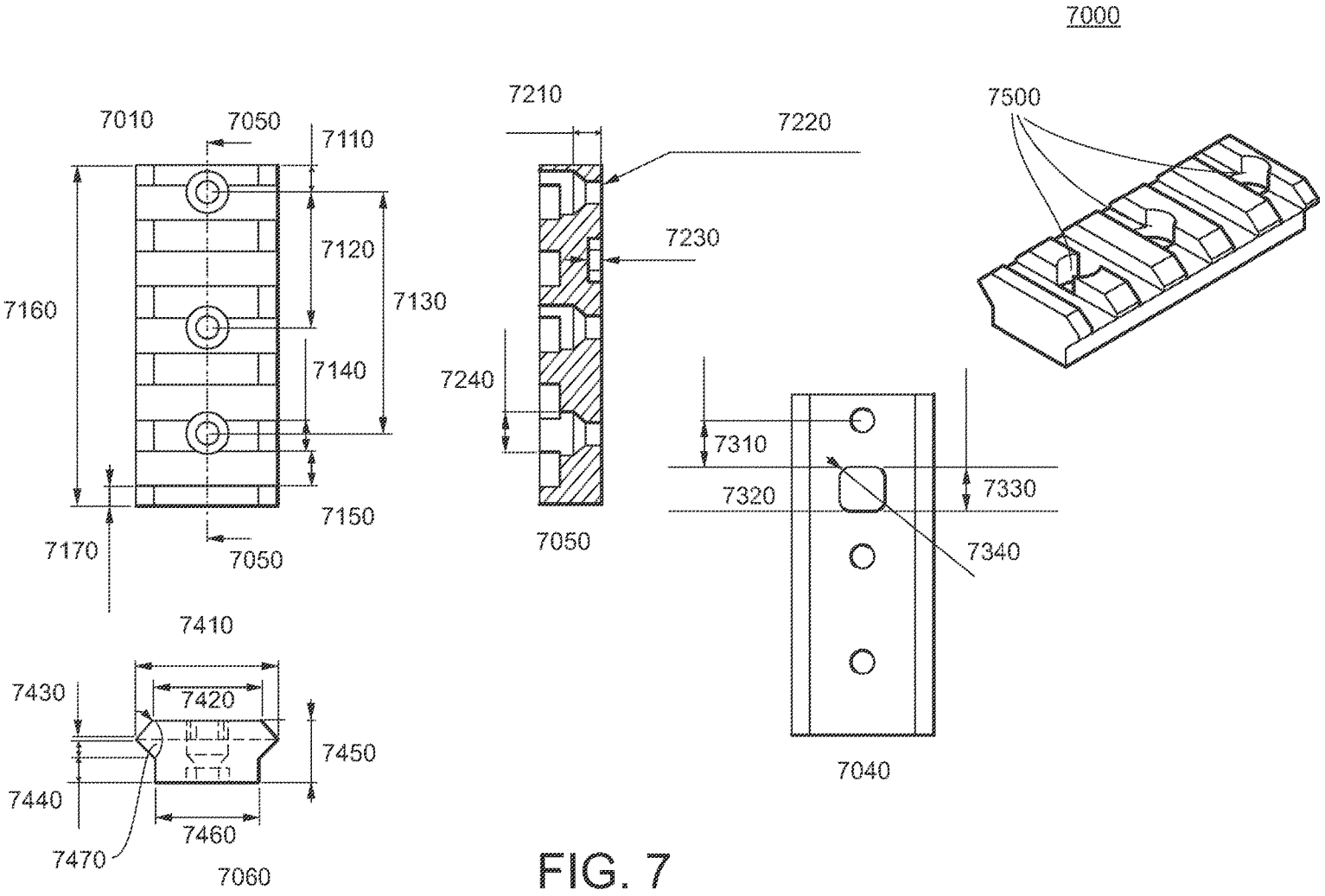
FIG. 7 is a detailed drawing showing five views of an exemplary embodiment of a cap 7000.

FIG. 7 is a detailed drawing showing five views of an exemplary embodiment of a cap 7000, which defines a "Picattiny rail" as that phrase is understood by those skilled in the art of firearms construction and use. Via cap 7000, a sight compatible with the Picattiny rail can be releasably coupled to a firearm coupled to cap 7000. Cap 7000 also defines a recoil lug cavity, which is constructed to restrain motion of cap 7000 in at least two directions relative to a body of the firearm when cap 7000 is operatively coupled thereto. In the illustrated embodiment, the recoil lug cavity is substantially square shaped with rounded corners. The recoil lug can either protrude or be a recessed cavity to compatibly engage with a corresponding lug of a base (e.g., a base defined by a surface of a firearm).

Detailed dimensions and fabrication instructions can be selected to comport to dimensions of any firearm. Plan view 7010 of cap 7000 can define a cross-section 7050. A typical length 7160 of cap 7000 can be approximately 2.000 inches with a tolerance of approximately −0.002 inches (i.e., up to 0.002 inches less than 2.000 inches). Other dimensions shown in plan view 7010 can be as follows:

- centerline offset 7110 can be approximately 0.16 inches;
- centerline distance 7120 can be approximately 0.80 inches;
- centerline distance 7130 can be approximately 1.42 inches;
- rail width 7140 can be approximately 0.188 inches for each of four rails;
- rail gap 7150 can be approximately 0.21 inches for each of five rail gaps and/or
- rail end width 7170 can be approximately 0.11 inches for each of the two illustrated rail ends.

Cross-section 7050 can define other typical dimensions and/or fabrication instructions. Dimensions and/or instructions for cross-section 7050 can be as follows for an exemplary embodiment:

- rail depth 7210 can be approximately 0.17 inches for each of the three illustrated bore holes 7500;
- instruction 7220 can specify a chamfer of approximately 0.010 inches for each of the three illustrated bore holes 7500;
- recoil lug depth 7230 can be approximately 0.08 inches; and/or
- aperture head diameter 7240 can be approximately 0.25 inches for each of the three illustrated bore holes 1500.

End view 7060 can comprise the following dimensions and/or characteristics:

- rail width 7410 can be approximately 0.835 inches;
- rail cap width 7420 can be approximately 0.636 inches;
- rail flange thickness 7430 can be approximately 0.02 inches;
- rail base thickness 7440 can be approximately 0.15 inches;
- rail thickness 7450 can be approximately 0.367 inches;
- rail base width 7460 can be approximately 0.617 inches; and/or
- rail angle 7470 can be approximately 90 degrees.

Bottom view 7040 of cap 7000 defines the following typical dimensions:

- a distance 7310 of recoil lug 1800 can be approximately 0.275 inches with a tolerance of approximately +0.002 inches;
- a recoil lug width 7320 can be approximately 0.250 inches with a tolerance of approximately +0.002 inches;
- a recoil lug width 7330 can be 0.250 inches with a tolerance of approximately +0.002 inches; and/or
- radius of curvature 7340 can be approximately 0.06 inches.

Figure 7A:
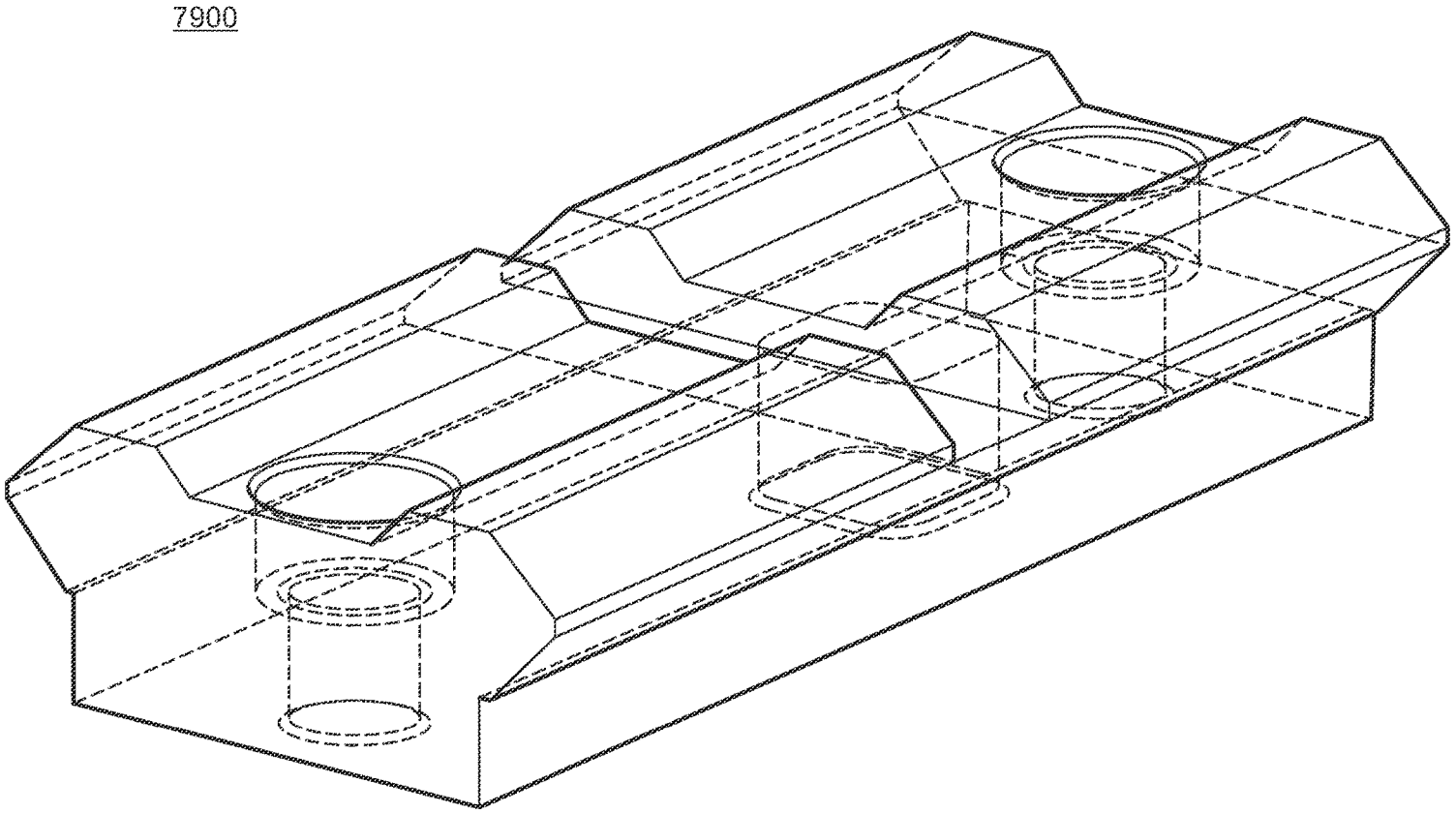
FIG. 7A is a perspective view of an exemplary embodiment of a cap 7900.

FIG. 7A is a perspective view of an exemplary embodiment of a cap 7900, which illustrates the apertures and the recoil lug with internal portions shown by dashed lines.

Figure 8:
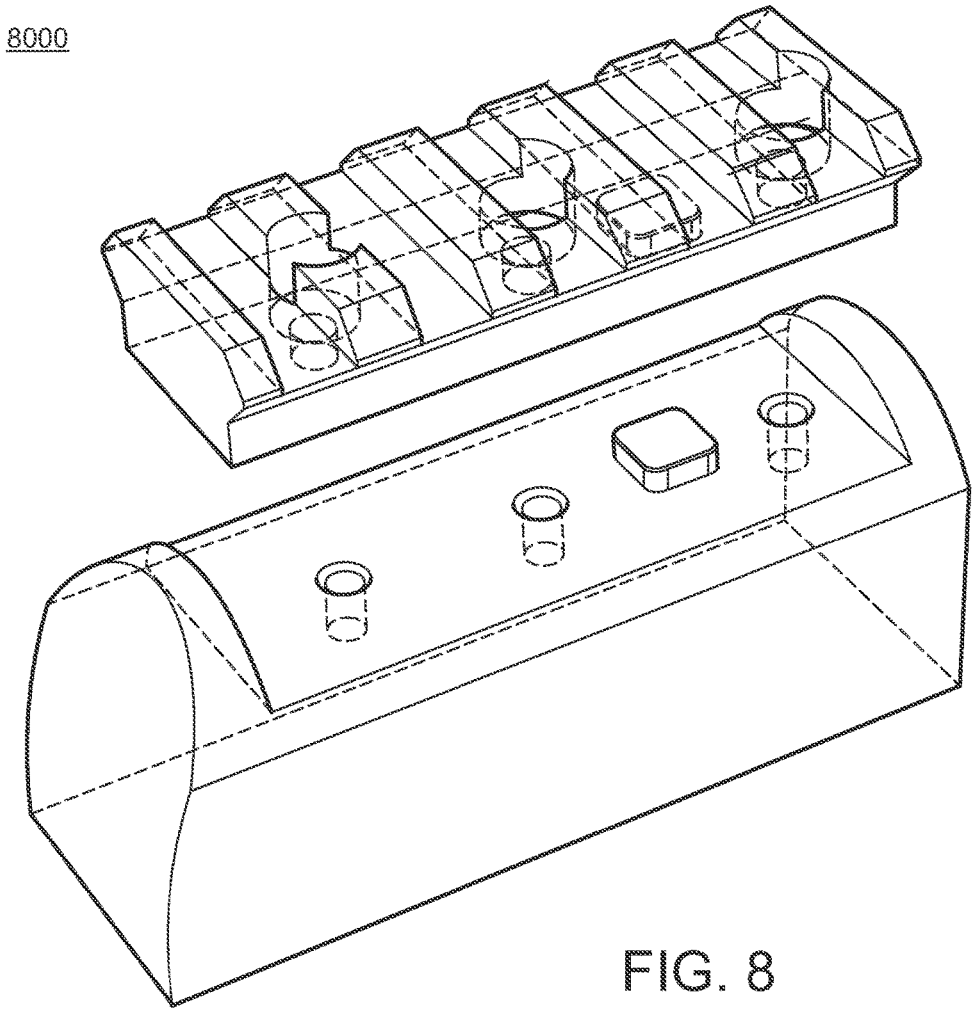
FIG. 8 is a perspective view of an exemplary embodiment of a system 8000.

FIG. 8 is a perspective view of an exemplary embodiment of a system 8000, which comprises a base and a cap. The cap comprises a Picattiny rail. System 8000 is constructed to releasably couple a firearm to a sight. The base comprises a recessed portion, which defines a plurality of bore holes and comprises a protruding recoil lug. The cap defines a plurality of cap bore holes and a recessed recoil lug portion. The recessed recoil lug portion is constructed to tightly engage with the protruding recoil lug portion of the base such that motion of the cap is restrained in all three directions when a cap of system 8000 is coupled to a base of system 8000 via fasteners.

Figure 9:
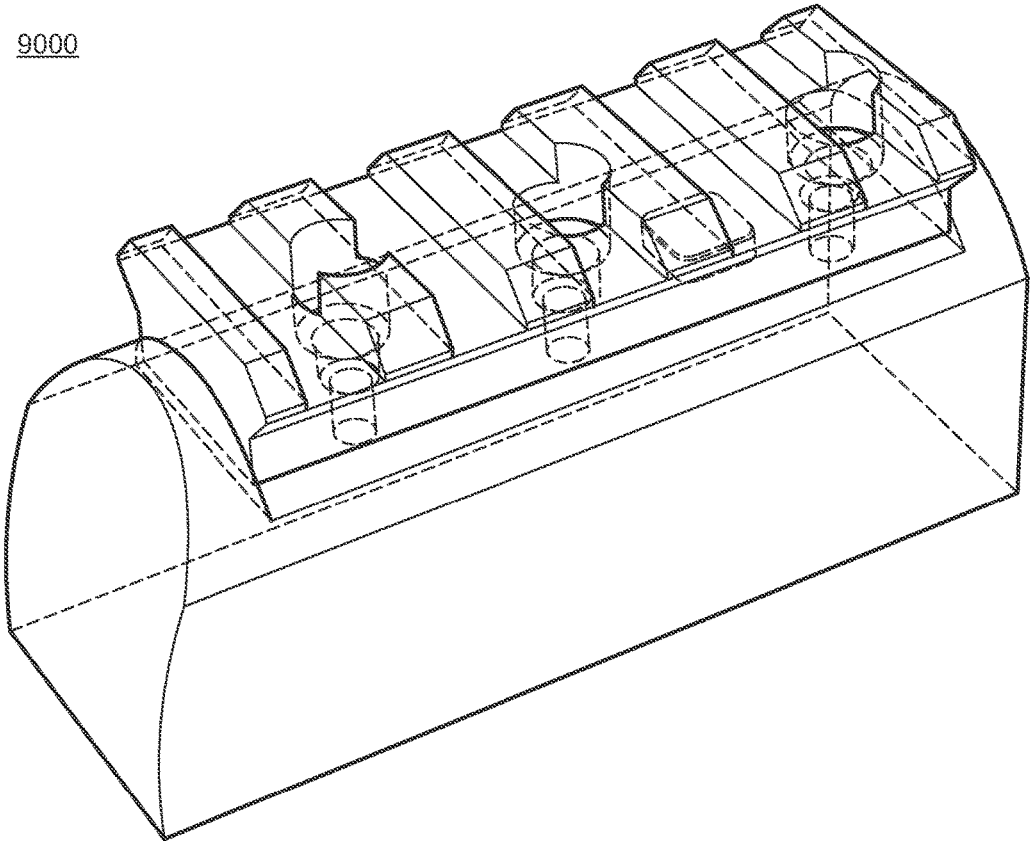
FIG. 9 is a perspective view of an exemplary embodiment of a system 9000.

FIG. 9 is a perspective view of an exemplary embodiment of a system 9000, which illustrates substantially similar components to those of system 8000 that are engaged with one another.

Figure 10:
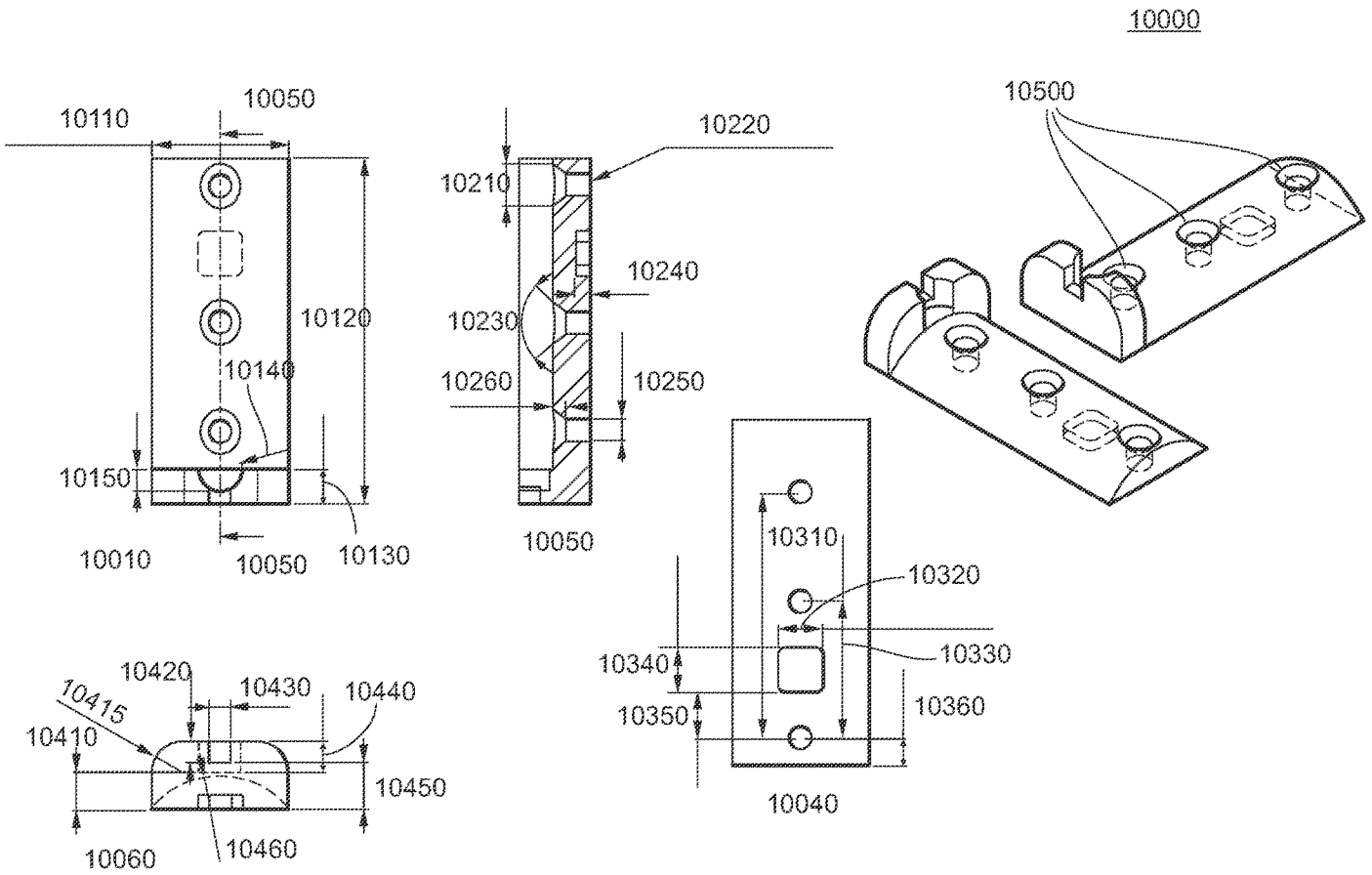
FIG. 10 is detailed drawing showing six views of an exemplary embodiment of a cap 10000.

FIG. 10 is detailed drawing showing six views of an exemplary embodiment of a cap 10000, comprises a sight for a firearm. The illustrated embodiment defines a plurality of bore holes 10500 constructed to receive fasteners and, thereby, to be releasably coupled to a first corresponding plurality of apertures defined by a base. Cap 10000 also comprises a recoil lug or recoil lug cavity, which is constructed to restrain motion of cap 10000 in at least two directions relative to the body of the firearm when engaged with a corresponding recoil lug or recoil lug cavity of a base. In the illustrated embodiment, the recoil lug is substantially square shaped with rounded corners. The recoil lug can either protrude or be recessed to compatibly engage with a corresponding lug of the base. As illustrated, cap 10000 comprises a substantially planar mounting surface, with the exception of the recoil lug, and a rounded convex apex surface (with the exception of the sight and the bore holes.

Detailed dimensions and fabrication instructions can be selected to comport to dimensions of any firearm. Plan view 10010 of cap 7000 can define a cross-section 10050. A typical length 10120 of cap 10000 can be approximately 2.000 inches with a tolerance of approximately −0.002 inches (i.e., up to 0.002 inches less than 2.000 inches). Other dimensions shown in plan view 10010 can be as follows:

- cap width 10110 can be approximately 0.16 inches;
- aperture depth 10130 can be approximately 0.80 inches;
- angle 10140 can be approximately 1.42 inches; and/or
- aperture countersink depth 10150 can be approximately 0.188 inches.

Cross-section 10050 can define other typical dimensions and/or fabrication instructions. Dimensions and/or instructions for cross-section 10050 can be as follows for an exemplary embodiment:

- aperture diameter 10210 can be approximately 0.25 inches for each of the three illustrated bore holes 10500;
- instruction 10220 can specify a chamfer of approximately 0.010 inches for each of the three illustrated bore holes 7500;
- angle 10230 can be approximately 82 degrees;
- recoil lug depth 10240 can be approximately 0.08 inches;
- aperture diameter 10250 can be approximately 0.14 inches for each of the three illustrated bore holes 10500; and/or
- countersink depth 10260 can be approximately 0.07 inches for each of the three illustrated bore holes 10500.

End view 10060 can comprise the following dimensions and/or characteristics:

- cap base thickness 10410 can be approximately 0.22 inches;

radius 10415 can be approximately 0.188 inches for each of two curved surfaces;

aperture depth 10420 can be approximately 0.125 inches;

aperture diameter 10430 can be approximately 0.125 inches;

cap apex thickness 10440 can be approximately 0.180 inches;

cap base thickness 10450 can be approximately 0.500 inches; and/or radius 10460 can be approximately 0.500 inches.

Bottom view 10040 of cap 10000 defines the following typical dimensions:

a centerline distance 10310 can be approximately 1.420 inches;

a recoil lug width 10320 can be approximately 0.250 inches with a tolerance of approximately +0.002 inches;

a centerline distance 10330 can be approximately 0.80 inches;

a recoil lug length 10340 can be approximately 0.250 inches with a tolerance of approximately +0.002 inches;

a centerline distance 10350 can be 0.275 inches; and/or an edge distance 10360 can be approximately 0.155 inches.

Figure 10A:
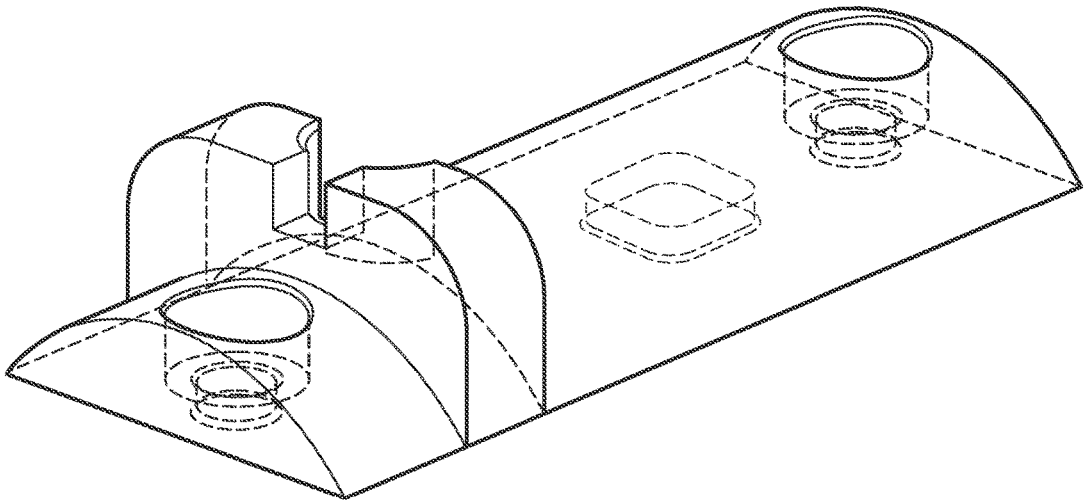
FIG. 10A is a perspective view of an exemplary embodiment of a cap 10900.

FIG. 10A is a perspective view of an exemplary embodiment of a cap 10900, which illustrates the apertures and the recoil lug with internal portions shown by dashed lines.

Figure 11:
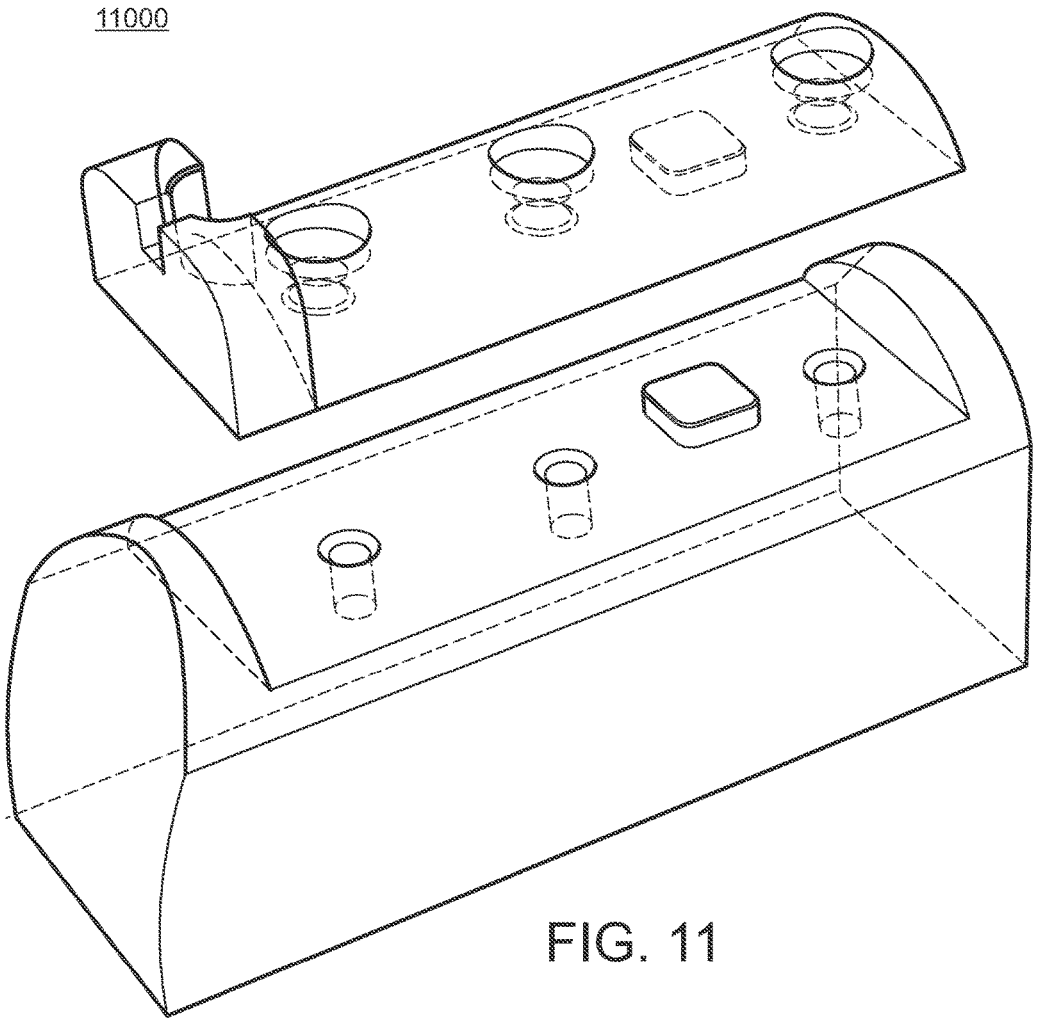
FIG. 11 is a perspective view of an exemplary embodiment of a system 11000.

FIG. 11 is a perspective view of an exemplary embodiment of a system 11000, which comprises a base and a cap. The cap is constructed to be releasably coupled to the base. The base comprises a recessed portion, which defines a plurality of bore holes and comprises a protruding recoil lug. The cap defines a plurality of cap bore holes and a recessed recoil lug portion. The recessed recoil lug portion is constructed to tightly engage with the protruding recoil lug portion of the base such that motion of the base is restrained in all three directions when the cap is coupled to the base via fasteners.

Figure 12:
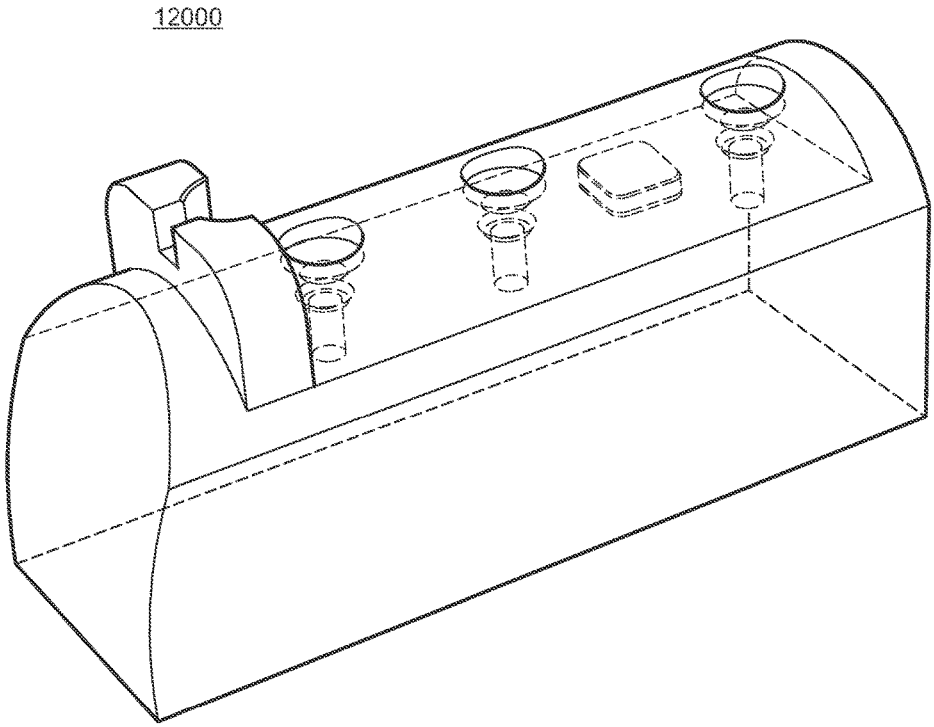
FIG. 12 is a perspective view of an exemplary embodiment of a system 12000.

FIG. 12 is a perspective view of an exemplary embodiment of a system 12000, which comprises a sight and can be releasably coupled to a firearm. System 12000 defines a plurality of bore holes constructed to receive fasteners and, thereby, a cap of system 12000 is releasably coupled to a base of system 12000.

Figure 13:
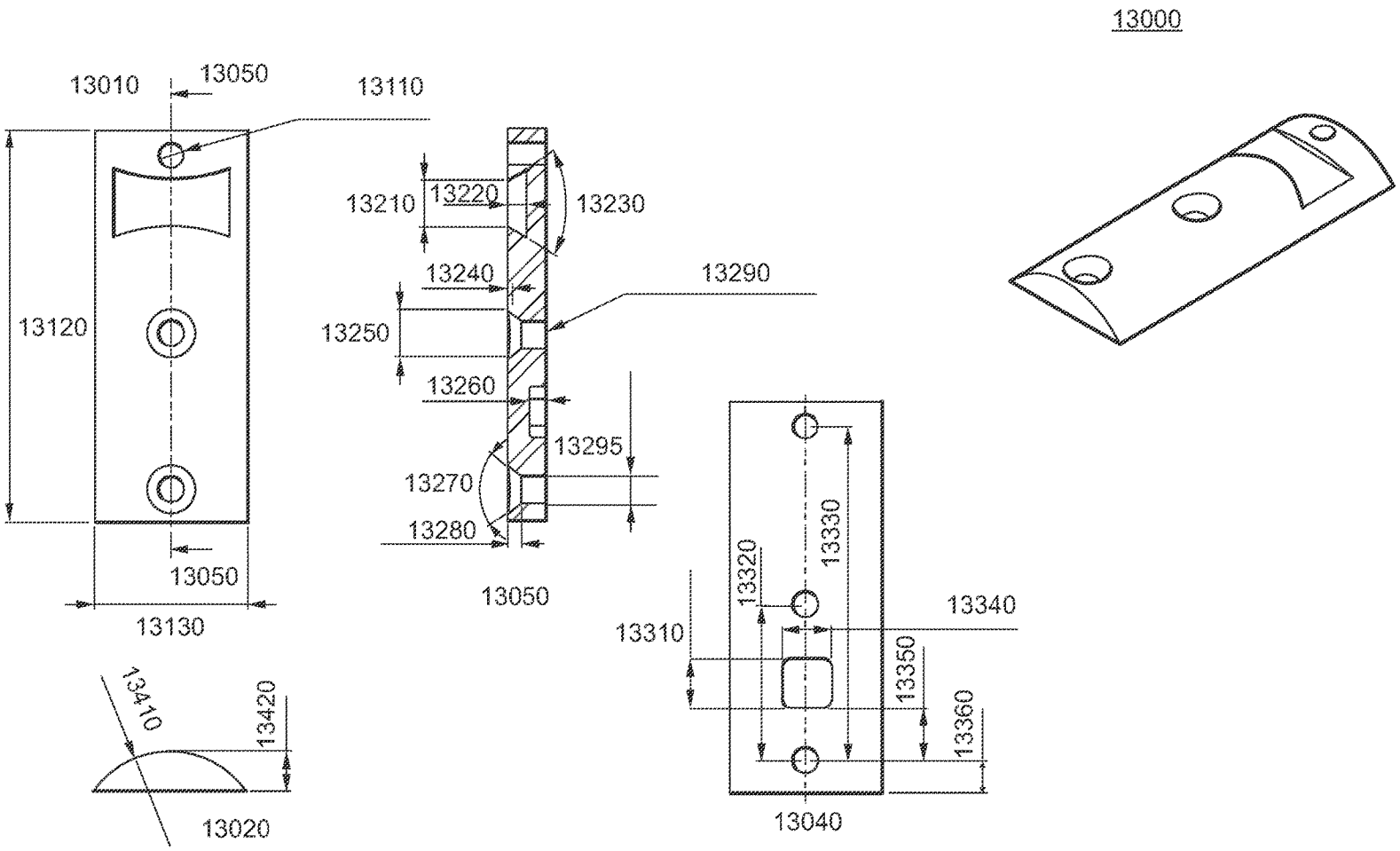
FIG. 13 is detailed drawing showing five views of an exemplary embodiment of a cap 13000.

FIG. 13 is detailed drawing showing five views of an exemplary embodiment of a cap 13000, which can be constructed to accept a sight for a firearm. Cap 13000 defines a plurality of bore holes constructed to receive fasteners and, thereby, to be releasably coupled to a first corresponding plurality of apertures defined by a base defined by a body of a firearm. The illustrated embodiment further defines a slot a sight for the firearm.

Detailed dimensions and fabrication instructions can be selected to comport to dimensions of any firearm. Plan view 13010 of cap 13000 can define a cross-section 13050. A typical length 13120 of cap 13000 can be approximately 2.000 inches with a tolerance of approximately −0.002 inches (i.e., up to 0.002 inches less than 2.000 inches). A typical width 13130 of cap 13000 can be approximately 0.800 inches with a tolerance of approximately +/−0.005 inches (i.e., up to 0.005 inches above or below 0.800 inches). Aperture diameter instructions 13110 can specify a diameter of approximately 0.119 inches to a depth of approximately 0.190 inches with 6-48—2B threads to a depth of approximately 0.190 inches.

Cross-section 13050 can define other typical dimensions and/or fabrication instructions. Dimensions and/or instructions for cross-section 13050 can be as follows for an exemplary embodiment:

recess width 13210 can be approximately 0.244 inches;

recess depth 13220 can be approximately 0.100 inches;

angle 13230 can be approximately sixty (60) degrees;

fastener flange depth 13240 can be approximately 0.02 inches for each of the bore holes;

aperture diameter 13250 can be approximately 0.25 inches for each of the bore holes;

recoil lug cavity depth 13260 can be approximately 0.08 inches;

angle 13270 can be approximately eighty two (82) degrees for each of the bore holes;

aperture countersink depth 13280 can be approximately 0.09 inches for each of the bore holes;

instruction 13290 can specify a chamfer for each aperture of approximately 0.10 inches; and/or aperture diameter 13295 can be approximately 0.14 inches for each of the bore holes.

End view 13020 can specify the following:

a radius 13410 can be approximately 0.50 inches; and/or a cap thickness 13420 can be approximately 0.200 inches.

Bottom view 13040 of cap 13000 defines the following typical dimensions:

recoil lug length 13310 can be approximately 0.250 inches with a tolerance of approximately +0.002 inches;

centerline offset 13320 can be approximately 0.800 inches;

aperture offset 13330 can be approximately 1.720 inches;

recoil lug width 13340 can be approximately 0.250 inches with a tolerance of approximately +0.002 inches;

offset length 13350 can be approximately 0.275 inches; and/or offset distance 13360 can be approximately 0.155 inches.

Figure 14:
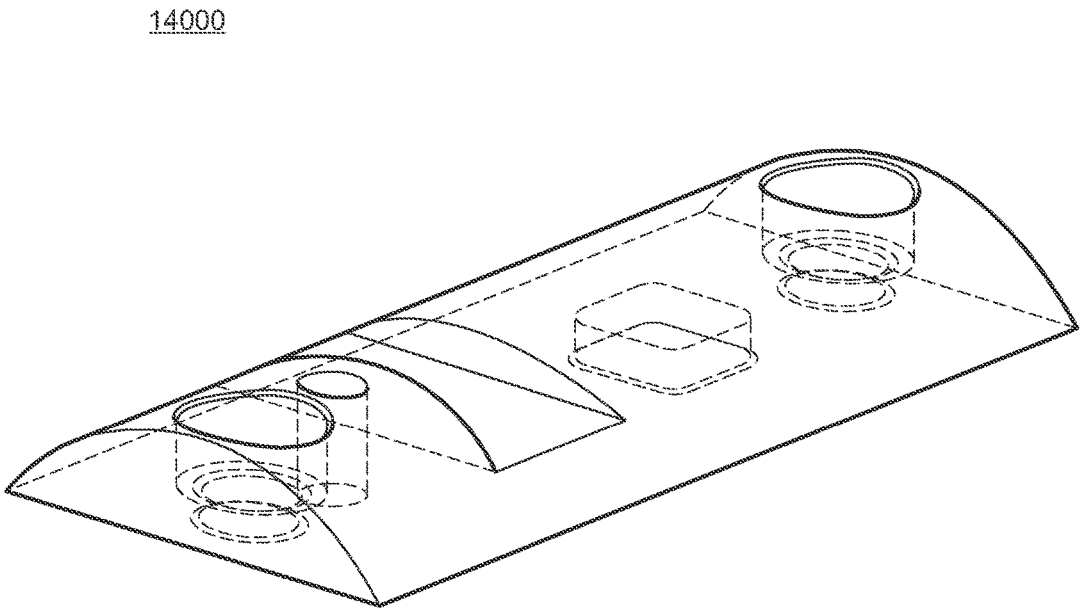
FIG. 14 is a perspective view of an exemplary embodiment of a cap 14000.

FIG. 14 is a perspective view of an exemplary embodiment of a cap 14000, which illustrates the apertures and the recoil lug with internal portions shown by dashed lines.

Certain exemplary embodiments provide a method, which can comprise causing a gun sight base to be coupled to a cap. A gun sight base can define a plurality of apertures. The cap is coupleable to the gun sight base. A recoil lug defined by one of the gun sight base and the cap are constructed to engage with a corresponding cavity defined by whichever of the gun sight base and the cap does not define the recoil lug. When the gun sight base and the cap are coupled, the recoil lug restrains motion of the cap in at least two substantially perpendicular directions relative to a body of the firearm coupled to the cap. The method can further comprise causing the firearm to be coupled the cap and/or causing a scope to be coupled the cap.

Definitions

When the following terms are used substantively herein, the accompanying definitions apply. These terms and definitions are presented without prejudice, and, consistent with the application, the right to redefine these terms during the prosecution of this application or any application claiming priority hereto is reserved. For the purpose of interpreting a claim of any patent that claims priority hereto, each definition (or redefined term if an original definition was amended during the prosecution of that patent), functions as a clear and unambiguous disavowal of the subject matter outside of that definition.

a—at least one.
activity—an action, act, step, and/or process or portion thereof.
adapter—a device used to effect operative compatibility between different parts of one or more pieces of an apparatus or system.
adjustable sight—a firearm sight that can be changed to improve an aim of a firearm to which the adjustable sight is coupled.
and/or—either in conjunction with or in alternative to.
aperture—an opening or hole.
apparatus—an appliance or device for a particular purpose
associate—to join, connect together, and/or relate.
body—a main portion of an object or system.
can—is capable of, in at least some embodiments.
cap—an object that covers a portion of a surface of a gun sight base.
cause—to bring about an act.
comprising—including but not limited to.
configure—to make suitable or fit for a specific use or situation.
connect—to join or fasten together.
constructed to—made suitable or fit for a specific use or situation.
coupleable—capable of being joined, connected, and/or linked together.
coupling—linking in some fashion.
define—to establish the outline, form, or structure of.
device—a machine, manufacture, and/or collection thereof.
direction—a line along which something might move.
fiber optic sight—an open sight on a firearm that comprises a substantially transparent fiber made by drawing glass (silica) or plastic.
firearm—a weapon from which a shot is discharged by gunpowder.
firearm sight—a device couplable to a firearm that assists in aiming the firearm.
fixed sight—a firearm sight that is not adjustable and lacks a lens.
gun sight base—a solid object that is couplable to a cap via one or more fasteners and is also coupleable to a firearm sight.
install—to connect or set in position and prepare for use.
may—is allowed and/or permitted to, in at least some embodiments.
method—a process, procedure, and/or collection of related activities for accomplishing something.
night sight—a firearm sight that provides optical assistance to a user of a firearm in dark conditions.
open sight—a system of shaped alignment markers used as a sighting device to assist in the aiming of a firearm.
perpendicular—substantially at right angles with.
Picattiny rail—a bracket on some firearms that provides a standard mounting platform comprising rails with multiple transverse slots similar in concept to the earlier commercial Weaver rail mount used to mount telescopic sights.
plurality—the state of being plural and/or more than one.
predetermined—established in advance.
recoil lug—a protrusion from an object that engages with a cavity of another object that restrains motion of the object relative to the another object when the protrusion is engaged with the cavity.
scope—an optical device and/or system couplable to a firearm that assists in aiming the firearm
set—a related plurality.
square—a rectangle in which all four sides are substantially of equal length.
substantially—to a great extent or degree.
support—to bear the weight of, especially from below.
system—a collection of mechanisms, devices, machines, articles of manufacture, processes, data, and/or instructions, the collection designed to perform one or more specific functions.
via—by way of and/or utilizing.

Note

Still other substantially and specifically practical and useful embodiments will become readily apparent to those skilled in this art from reading the above-recited and/or herein-included detailed description and/or drawings of certain exemplary embodiments. It should be understood that numerous variations, modifications, and additional embodiments are possible, and accordingly, all such variations, modifications, and embodiments are to be regarded as being within the scope of this application.

Thus, regardless of the content of any portion (e.g., title, field, background, summary, description, abstract, drawing figure, etc.) of this application, unless clearly specified to the contrary, such as via explicit definition, assertion, or argument, with respect to any claim, whether of this application and/or any claim of any application claiming priority hereto, and whether originally presented or otherwise:

there is no requirement for the inclusion of any particular described or illustrated characteristic, function, activity, or element, any particular sequence of activities, or any particular interrelationship of elements;
no characteristic, function, activity, or element is "essential";
any elements can be integrated, segregated, and/or duplicated;
any activity can be repeated, any activity can be performed by multiple entities, and/or any activity can be performed in multiple jurisdictions; and
any activity or element can be specifically excluded, the sequence of activities can vary, and/or the interrelationship of elements can vary.

Moreover, when any number or range is described herein, unless clearly stated otherwise, that number or range is approximate. When any range is described herein, unless clearly stated otherwise, that range includes all values therein and all subranges therein. For example, if a range of 1 to 10 is described, that range includes all values therebetween, such as for example, 1.1, 2.5, 3.335, 5, 6.179, 8.9999, etc., and includes all subranges therebetween, such as for example, 1 to 3.65, 2.8 to 8.14, 1.93 to 9, etc.

When any claim element is followed by a drawing element number, that drawing element number is exemplary and non-limiting on claim scope. No claim of this application is intended to invoke paragraph six of 35 USC 112 unless the precise phrase "means for" is followed by a gerund.

Any information in any material (e.g., a United States patent, United States patent application, book, article, etc.) that has been incorporated by reference herein, is only incorporated by reference to the extent that no conflict exists between such information and the other statements and drawings set forth herein. In the event of such conflict, including a conflict that would render invalid any claim herein or seeking priority hereto, then any such conflicting information in such material is specifically not incorporated by reference herein.

Accordingly, every portion (e.g., title, field, background, summary, description, abstract, drawing figure, etc.) of this application, other than the claims themselves, is to be regarded as illustrative in nature, and not as restrictive, and the scope of subject matter protected by any patent that issues based on this application is defined only by the claims of that patent.

What is claimed is:

1. A system comprising:

a gun sight base defined by a surface of a firearm, said gun sight base defining a plurality of apertures; and a cap, said cap coupleable to said gun sight base via a plurality of fasteners, each of said plurality of fasteners coupled to said firearm via one of said plurality of apertures, a single recoil lug defined by one of said gun sight base and said cap constructed to engage with a corresponding cavity defined by whichever of said gun sight base and said cap does not define said recoil lug, said recoil lug not defining any of said plurality of apertures, wherein when said cap is coupled to said gun sight base:

said recoil lug and each of said plurality of apertures define respective centerlines such that all of said centerlines are aligned along a single longitudinal axis; and said recoil lug restrains motion of said cap in at least two substantially perpendicular directions relative to a body of said firearm.

2. The system of claim 1, further comprising:

said firearm.

3. The system of claim 1, further comprising:

a scope coupled to said cap.

4. The system of claim 1, wherein:

said recoil lug is substantially square with rounded corners.

5. The system of claim 1, wherein:

said gun sight base defines said recoil lug.

6. The system of claim 1, wherein:

said cap defines said recoil lug.

7. The system of claim 1, wherein:

said cap is coupled to a fixed sight.

8. The system of claim 1, wherein:

said cap is coupled to an adjustable sight.

9. The system of claim 1, wherein:

said cap is coupled to a night sight.

10. The system of claim 1, wherein:

said cap defines a Picattiny rail.

11. The system of claim 1, wherein:

said cap is coupled to a fiber optic sight.

12. The system of claim 1, wherein:

said cap defines an open sight.

13. A method comprising:

causing a gun sight base to be coupled to a cap, said gun sight base defining a plurality of apertures, said cap coupleable to said gun sight base via a plurality of fasteners, each of said plurality of fasteners coupled to said firearm via one of said plurality of apertures, a single recoil lug defined by one of said gun sight base and said cap constructed to engage with a corresponding cavity defined by whichever of said gun sight base and said cap does not define said recoil lug, wherein when said gun sight base and said cap are coupled:

said recoil lug and each of said plurality of apertures define respective centerlines such that all of said centerlines are aligned along a single longitudinal axis; and said recoil lug restrains motion of said cap in at least two substantially perpendicular directions relative to a body of said firearm coupled to said cap.

14. The method of claim 13, further comprising:

causing said firearm to be coupled said gun sight base.

15. The method of claim 13, wherein:

causing a scope to be coupled said cap.

* * * * *